US009814963B2

(12) United States Patent
Costain

(10) Patent No.: US 9,814,963 B2
(45) Date of Patent: Nov. 14, 2017

(54) CUE SHAFT TIP INSERT

(71) Applicant: CLAWSON CUSTOM CUES, INC., Jacksonville, FL (US)

(72) Inventor: Paul D. Costain, Beverly, MA (US)

(73) Assignee: CLAWSON CUSTOM CUES, INC., Jacksonville, FL (US)

( * ) Notice: Subject to any disclaimer, the term of this patent is extended or adjusted under 35 U.S.C. 154(b) by 0 days.

(21) Appl. No.: 15/129,186

(22) PCT Filed: Mar. 20, 2015

(86) PCT No.: PCT/US2015/021645
§ 371 (c)(1),
(2) Date: Sep. 26, 2016

(87) PCT Pub. No.: WO2015/148289
PCT Pub. Date: Oct. 1, 2015

(65) Prior Publication Data

US 2017/0173446 A1 Jun. 22, 2017

Related U.S. Application Data

(60) Provisional application No. 61/969,562, filed on Mar. 24, 2014.

(51) Int. Cl.
*A63D 15/12* (2006.01)
*A63D 15/08* (2006.01)

(52) U.S. Cl.
CPC ..... *A63D 15/12* (2013.01); *A63D 15/08* (2013.01)

(58) Field of Classification Search
CPC ..... A63D 15/12
(Continued)

(56) References Cited

U.S. PATENT DOCUMENTS 1,536,652 A 5/1925 Brockway
2,072,484 A * 3/1937 Nyhagen ..... A63D 15/12 473/51

(Continued)

FOREIGN PATENT DOCUMENTS

CN 2362546 2/2000
JP 2010227189 10/2010

(Continued)

*Primary Examiner* — Aarti B Berdichevsky
*Assistant Examiner* — Rayshun Peng
(74) *Attorney, Agent, or Firm* — Terry M. Sanks, Esq.; Beusse Wolter Sanks & Maire, PLLC

(57) ABSTRACT

A tip insert for a cue shaft having a cavity at the tip has a tip disc to support a tip for striking a ball and an inwardly extending section for bonding to the inside surface of the cavity. The inwardly extending section includes one or more centering flanges and a bonding surface, the centering flanges interfacing with the inner surface of the cavity and enabling a substantially consistence bond distance between the bonding surface and the inner surface of the cavity. The tip insert can be machine from a single piece of material comprising glass fiber-reinforced epoxy laminate sheets, where the individual sheets of the material are oriented perpendicular to the longitude axis of the tip insert to increase the durability and performance of the tip insert when transferring the force from the tip striking a ball.

28 Claims, 17 Drawing Sheets

(58) Field of Classification Search
USPC ..... 473/49, 51, 47, 44
See application file for complete search history.

(56) References Cited

U.S. PATENT DOCUMENTS

| | | | | |
|---|---|---|---|---|
| 3,381,960 | A | 5/1968 | Reinhart | |
| 6,183,371 | B1 | 2/2001 | Wethered | |
| 6,719,638 | B2 | 4/2004 | Wethered | |
| 7,201,666 | B1 * | 4/2007 | Chan | A63D 15/12 473/51 |
| 2003/0036434 | A1 | 2/2003 | Wu | |
| 2006/0019761 | A1 | 1/2006 | Titus | |
| 2006/0205525 | A1 | 9/2006 | Owen | |
| 2007/0010340 | A1 | 1/2007 | Miki | |
| 2007/0219009 | A1 * | 9/2007 | Sullivan | A63D 15/12 473/49 |
| 2007/0281794 | A1 | 12/2007 | Thurber | |
| 2009/0270192 | A1 | 10/2009 | Titus et al. | |

FOREIGN PATENT DOCUMENTS

| | | |
|---|---|---|
| WO | 2006107707 | 10/2006 |
| WO | 2007106846 | 9/2007 |

* cited by examiner

FIGS. 10A-D

MATERIAL NOTE:

1. BLACK G10/FR4 LAMINATE SHEET 3/8 THICK.

MATERIAL NOTE:

1. BLACK G10/FR4 LAMINATE SHEET ONLY

CUE SHAFT TIP INSERT

CROSS-REFERENCE TO RELATED APPLICATIONS

This application is a 371 National Stage of PCT/US2015/021645 filed Mar. 20, 2015, which claims the benefit of U.S. Provisional No. 61/969,562 filed Mar. 24, 2014, the entire contents of which are hereby incorporated by reference in their entirety.

BACKGROUND OF THE INVENTION

Cues, also called billiard cues, pool cues, snooker cues, or carom cues, are employed in the games of billiards, pool and similar table games. Players use the cue, which typically has a handle end and a tip end, for hitting a hard cue ball into other balls. The tip end of the cue conventionally comprises a ferrule made of plastic or metal and a tip that becomes worn or even breaks due to use over time. Cue sticks utilize a variety of materials in their construction. In particular, the tip of a cue stick, which is used to strike a ball during a billiards game, is typically made of a different type of material (e.g., leather or linen phenolic) from the actual shaft construction of the cue stick (e.g., wood). The tip and ferrule assembly in the prior art is constantly in need of repair, particularly the tip held in place by the ferrule. As a result, various methods have been developed for attaching the tip to the remainder of a cue stick.

In the prior art, the tip of a cue stick is often attached to a shaft using a plug made of wood or plastic. Specifically, the shaft of the cue stick, at the distal end to which the tip is attached, has a cavity into which the plug is inserted. The tip is attached to the shaft by contact, through adhesive, with the tip end of the shaft and contact of the plug with the sides of the cavity. Repeated ball strikes by the tip over the life of the cue stick tend to weaken the bonding of the tip, resulting in eventual detachment of the tip from the remainder of the cue stick. This problem is especially prominent when the tip is directly bonded to a composite shaft surface because of the incompressibility of the composite material relative to the tip material. If a plug is not used, in the case where the tip is attached to the distal end of the shaft, the unequal loading of force on the tip causes especially high wear. Even linen phenolic tips exhibit substantial compressibility under the force necessary to strike a cue ball during a break shot.

In addition, the plug tends to increase the weight of the cue stick near the tip end, accentuating a phenomenon known as cue ball deflection. When a player imparts English to a cue ball by striking the cue ball away from its center of mass, as discussed in U.S. Pat. No. 6,162,128, the entire contents of which are hereby incorporated herein by reference, increased weight at the tip end of a shaft accentuates the deflection of a struck cue ball during off-center ball strikes.

SUMMARY OF THE INVENTION

A need exists to provide a more robust way of attaching a tip to the remainder of a cue stick having a weight-reducing cavity. Embodiments of the present invention are directed to addressing these needs.

An example embodiment is a cue shaft tip assembly that comprises a shaft with a cavity at a tip end, the cavity having an inner surface, and a tip insert at the tip end of the shaft, the tip insert having a tip disc and an inwardly extending section. The inwardly extending section of the tip insert comprises one or more aligning protrusions configured to interface with the inner surface of the cavity, a bonding surface between the one or more aligning protrusions, and an epoxy reservoir formed around the one or more aligning protrusions by at least the bonding surface and the inner surface of the cavity, and a tip at an end face of the tip disc for striking a ball. The one or more aligning protrusions can be one or more centering flanges. The one or more aligning protrusions can be axially aligned centering ribs. The tip insert may be machined from a single piece of material, avoiding bonding and stack up tolerance errors.

Additionally, in some embodiments, the tip is integrated with the tip insert such that the tip disc end surface defines the tip of the cue shaft assembly.

In some embodiments, the one or more aligning protrusions enable a substantially consistent bond distance between the inwardly extending section and the inner surface of the cavity in an epoxy reservoir of the tip insert. In some embodiments, the substantially consistent bonding distance is between 0.002 and 0.050 inches. The cavity of the cue shaft tip assembly may be a cylindrical cavity and the inwardly extending section of the tip insert may be an inwardly extending cylindrical section.

In some embodiments, the cue shaft is comprised of wood and the tip end of the cue shaft is an axial tenon. The tip assembly further comprises a ferrule adapted to surround an outer surface of the axial tenon. In another embodiment, an inner surface of the ferrule has one or more aligning protrusions, the one or more aligning protrusions interfacing with the outer surface of the axial tenon and enabling a consistent bond distance between the inner surface of the ferrule and the outer surface of the axial tenon. In some embodiments, the one or more aligning protrusions are a plurality of axially oriented centering ribs. In other embodiments, the one or more aligning protrusions are one or more centering flanges. In other embodiments, the shaft is comprised of carbon fibers and epoxy.

In some embodiments, the tip assembly further includes a tip silencer positioned between the tip and the tip disc. In one embodiment, the tip silencer has an axial length of at least 0.003 inches. In some embodiments, the tip silencer is constructed from vulcanized fiber or a composite material.

The tip insert may be comprised of fiber-reinforced epoxy laminate sheets, where at least a portion of the fiber-reinforced epoxy laminate sheets forming the tip disc are oriented perpendicular to a longitudinal axis of the shaft. In some embodiment, all of the fiber-reinforced epoxy laminate sheets forming the tip insert are oriented perpendicular to a longitudinal axis of the shaft. In some embodiments, the fiber-reinforced epoxy laminate sheets are selected from the group consisting of carbon fiber-reinforced epoxy laminate sheets and fiberglass epoxy laminate sheets. Specifically, the fiber-reinforced epoxy laminate sheets can be G-10/FR4 fiberglass epoxy laminate sheets.

The tip assembly may further include an adhesive in the epoxy reservoir. The adhesive secures the bonding surface of the tip insert to the inner surface of the cavity. The adhesive may be epoxy and in one embodiment, the epoxy is DP420.

In some embodiments, the bonding surface has an axial length of at least about 0.020 inches. In some embodiments, the bonding surface has an axial length between 0.050 and 0.600 inches.

In some embodiments, the bonding surface defines a surface area of at least 0.050 square inches. In some embodiments, the bonding surface defines a surface area between 0.100 and 0.600 square inches.

Another example embodiment is a tip insert for a cue, the tip insert comprises a tip disc and an inwardly extending section adapted to be inserted and attached to a tip end of a cue shaft having a cavity. The inwardly extending section of the tip disc comprises a bonding surface configured to be bonded to an inner surface of the cavity. The tip insert is made from fiber-reinforced epoxy laminate sheets, at least a portion of the fiber-reinforced epoxy laminate sheets forming the tip disc being oriented to be perpendicular to the longitudinal axis of the shaft. The tip insert can include a weight-reducing cavity. The tip insert can be machined from a single piece of material. The tip disc can include an integrated tip for striking a ball.

In some embodiments, the fiber-reinforced epoxy laminate sheets forming the tip insert are oriented perpendicular to a longitudinal axis of the shaft. The fiber-reinforced epoxy laminate sheets can be selected from the group consisting of carbon fiber-reinforced epoxy laminate sheets and fiberglass epoxy laminate sheets. In some embodiment, the fiber-reinforced epoxy laminate sheets are G-10/FR4 fiberglass epoxy laminate sheets.

The tip insert may further comprise one or more aligning protrusions configured to interface with the inner surface of the cavity, with the bonding surface being between the one or more aligning protrusions and the tip disc, and an epoxy reservoir formed between the one or more aligning protrusions and the bonding surface. The one or more aligning protrusions enable a consistent bond distance between the inwardly extending section and the inner surface of the cavity in the epoxy reservoir when positioned into the cavity of the shaft. The inwardly extending section can be a cylindrical inwardly extending section.

Yet another example embodiment is a method of assembling a tip of a cue. The method comprises positioning a tip disc of a tip insert against the tip of a shaft, with an inwardly extending section of the tip insert being in a cavity of the shaft, and bonding a bonding surface of the inwardly extending section of the tip insert to the cavity. The inwardly extending section comprises at least one flange. In some embodiments the method further includes centering the inwardly extending section of the tip insert in the cavity with the at least one flange. The flange of the inwardly extending section can interface with an inner surface of the cavity to substantially center the bonding surface about the inner surface.

The bonding surface of the inwardly extending section of a tip insert can be bonded to the inner surface of the cavity with a substantially consistent bond thickness. With a tip of the cue having a tenon, the method can include centering an inner surface of a ferrule around an outer surface of the tenon and a peripheral edge of the tip disc of the tip insert and bonding the inner surface of the ferrule to the tenon with a consistent bond thickness.

The method can further include bonding a tip for striking a ball to an end surface of the tip disc. Tip insert can be constructed from fiber-reinforced epoxy laminate sheets, where the sheets are oriented perpendicular to a longitudinal axis of the tip insert.

Another example embodiment is a cue shaft tip assembly that comprises a shaft with a cavity and an axial tenon at a tip end, the cavity having an inner surface and the axial tenon having an outer surface, a tip insert in the cavity at the tip end of the shaft, the tip insert comprising a bonding surface adapted to be bonded to the inner surface of the cavity, an integrated ferrule adapted to surround the outer surface of the axial tenon, and a tip at an end face of a tip disc of the integrated ferrule for striking a ball. The integrated ferrule comprises a tip disc adapted to cover the tip end of the shaft, an inner surface that includes a bonding surface and one or more inwardly facing aligning protrusions, the one or more inwardly facing aligning protrusions interfacing with the outer surface of the axial tenon, an epoxy reservoir formed around the one or more aligning protrusions by at least the bonding surface and the outer surface of the axial tenon, and the tip insert being made from fiber-reinforced epoxy laminate sheets, at least a portion of the fiber-reinforced epoxy laminate sheets forming the tip disc being oriented to be perpendicular to the longitudinal axis of the shaft. The tip insert may include a cavity.

The one or more aligning protrusions can center the inwardly extending section around the axial tenon and enable a consistent bond distance between the bonding surface of the integrated ferrule and the outer surface of the elongated axial tenon in the epoxy reservoir of the integrated ferrule. In some embodiments, the one or more aligning protrusions are one or more centering flanges. In some embodiments, the one or more aligning protrusions are a plurality of axially oriented centering ribs.

The integrated ferrule can be machined from a single piece of material comprising G-10/FR4 fiberglass epoxy laminate sheets oriented perpendicular to a longitudinal axis of the shaft. In some embodiments, the tip is integrated with the tip disc of the integrated ferrule, the tip and integrated ferrule being formed from a single piece of material.

The tip insert can further include one or more aligning protrusions for centering the tip insert in the cavity of the shaft and enabling a consistent bond distance between the inner surface of the cavity and the bonding surface of the tip insert. In some embodiment, the one or more aligning protrusions can be one or more centering flanges. In other embodiment, the one or more aligning protrusions are a plurality of axially oriented centering ribs.

The assembly may include a tip silencer positioned between the tip and the tip disc of the integrated ferrule.

The assembly can include an adhesive in the epoxy reservoir, the adhesive securing the bonding surface of the integrated ferrule to the outer surface of the axial tenon. In some embodiments, the adhesive is epoxy, specifically DP420.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Figure 1:
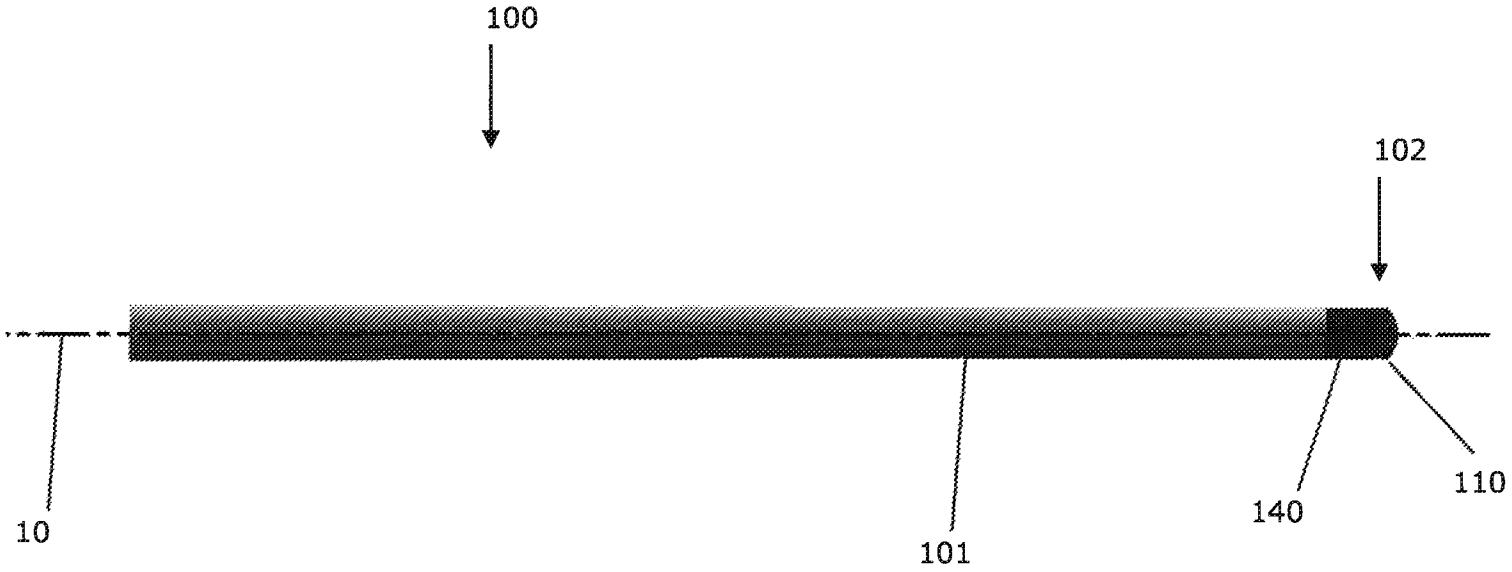
FIG. 1 is profile view of a typical billiards cue with embodiments of the present invention.

A description of example embodiments of the invention follows.

Players of billiards and pool and similar billiard table games use cue sticks for striking balls during the course of play. The conventional billiard cue is comprised of a grip end and a tip end. The tip end is typically fitted with a ferrule surrounding a portion of the end of the shaft, to which an impact-resistant tip is attached by adhesive. The ferrule absorbs some of the shock during ball striking thereby protecting the cue stick shaft from impact damage. Ferrules are typically made of high-impact materials that are resistant to cracking, chipping, and breaking, e.g., brass, ivory, carbon fiber, plastics, or phenolic resin. There are typical failures that occur, such as separation, breakage, and crack formation in the tip, ferrule and any surrounding adhesives because of inadequate materials, imperfect tolerances, or fixation methods.

The tip provides the interface during striking between the ball and the rest of the cue shaft. Tips typically have the shape of a disc or a low aspect ratio cylinder. One face of the tip is typically flat and sits on the end face of the ferrule and is held in place by a bonding adhesive.

The other tip face is the striking face of the tip and usually has a convex shape with some degree of curvature.

Repeated ball impact causes wear damage to the tip pad but also can weaken the bond between the tip and the ferrule and between the ferrule and the cue shaft. High impact shots, such as breaking shots, are particularly damaging. Modern cue shaft designs incorporate a bore or cavity in the shaft, the cavity extending from the tip end towards the grip end to reduce the weight of the tip end. As a result, these end-cavity designs include a particularly weak section of the shaft where the shaft is adhered to the ferrule and the tip assembly An objective of the present invention is to overcome at least some of the aforementioned problems of the prior art by providing an improved replaceable cue tip. Another objective of the present invention is to provide improved removable tip assemblies for cue sticks.

Conventionally, a damaged tip can be removed by breaking or dissolving the adhesive layer that holds the tip to the ferrule or by cutting away the tip material. Once removed, a new tip is glued into place. However, a broken or splintered shaft, often caused by a separation of the bond between the ferrule and the shaft, is typically irreparable.

Over the years, there have been numerous attempts to address the problem of shaft damage through different schemes for improving the durability the tip assemblies and improving the strength of their bond to a cue shaft end having a bore or cavity. However, prior art solutions suffer from one or more of the following disadvantages: undue complexity, material failure, and a tendency for unintended loosening of the tip assembly components caused by inconsistent bonding thicknesses creating asymmetric bond strength between the tip assembly and the tip end of the shaft. Generally, these asymmetries are a result of by stock up tolerance errors from multiple components and imprecise centering of the components having a bonding material between them.

FIG. 1 is profile view of a typical billiards cue with a tip insert having embodiments of the present invention. FIG. 1 shows a billiards cue 100 having embodiments of the present invention. The billiards cue 100 includes a shaft 101 with a center axis 10. Cue shafts 101 are typically constructed from wood or a composite material (e.g., fiber-reinforced epoxy laminates) or a material of similar properties. A tip assembly 102 is located at one end of the shaft 101.

The billiards cue 100 is typically a high aspect ratio tapering cylindrical shaft 101, the shaft 101 terminating with a tip assembly 102 at the narrow end of the tapering shaft 101.

Referring to FIG. 1, the tip assembly 102 includes a tip 110 and a ferrule 140, the ferrule 140 surrounds the terminal end of the shaft 101, protecting the shaft from cracking or splitting when the tip 110 repeated strikes a ball during a billiards or pool game. The tip 110 is a convex spherical shape, ideal for striking a ball across a range of angles of incidence, and typically made from a durable material, such as rubber, leather, or others known in the art. The ferrule 140 is an open cylindrical section, or a solid cylindrical section, adapted to interface with the tip end of the shaft 101, typically with an adhesive such as epoxy, and may transfer some of the three generated by the tip 110 striking a ball to the shaft 101.

Continuing to refer to FIG. 1, the tip assembly 101 and optionally a tip disk (220 in FIG. 2) between the ferrule 140 and the tip 110 to absorb some of the shock transferred from the tip 110 to the ferrule 140 and shaft 101 when the tip 10 strikes a ball. The tip 110 may be attached to the ferrule 140 alone, the end of the shaft 101 and the ferrule 140 in combination, or to the ferrule 140 and tip insert (230 in FIG. 2) positioned between the end of the shaft 101 and the tip 110. Additionally, shafts 101 constructed from composite material often do not require the protection of a ferrule 140, and in such configurations, the tip 101 is connected to the shaft 101 by a tip insert alone, as shown in FIG. 4.

Figure 2:
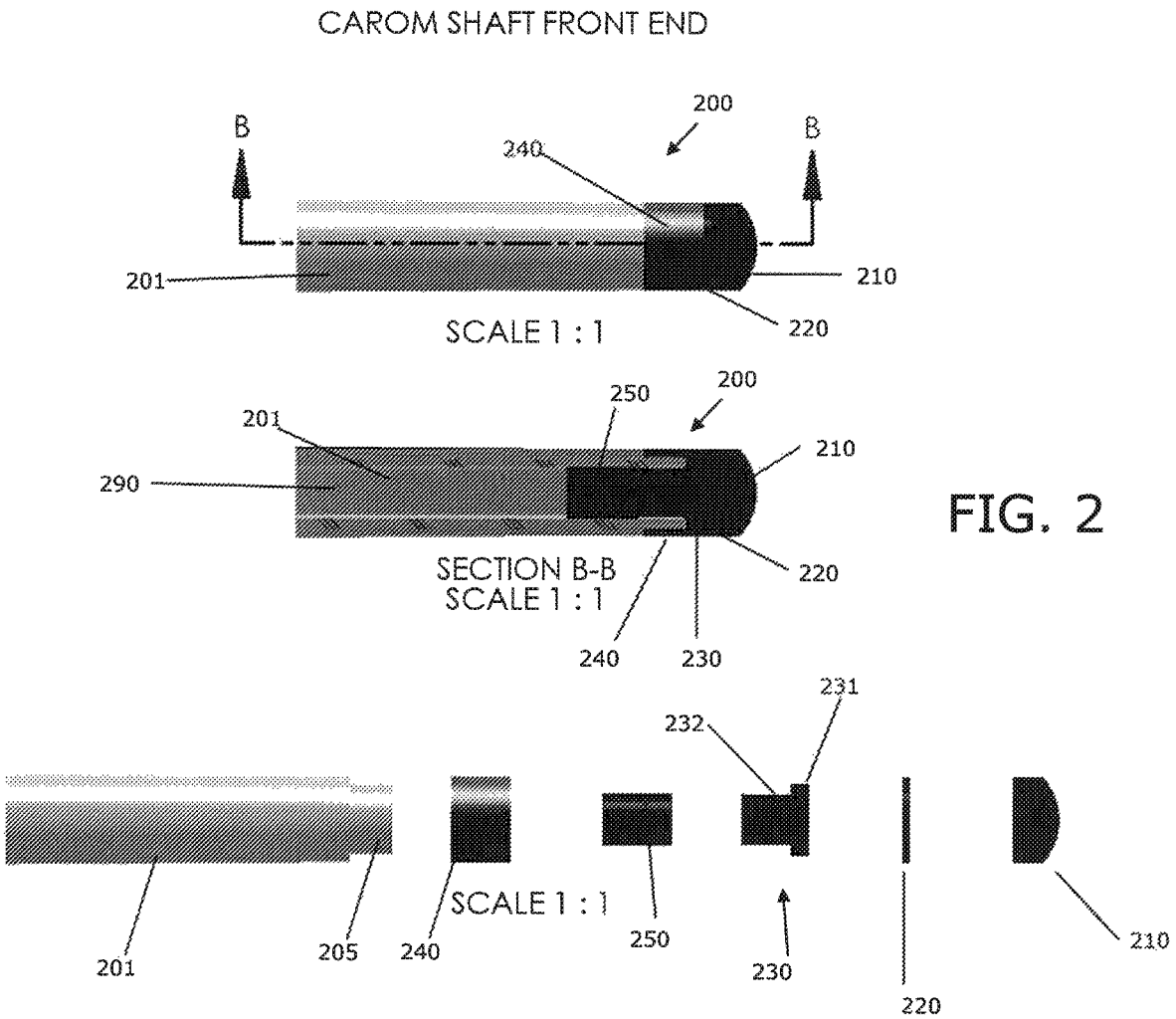
FIG. 2 is an assembly diagram of a carom shaft tip assembly embodiment of the present invention.

FIG. 2 is an assembly diagram of a carom shaft tip assembly 200 having embodiments of the present invention. FIG. 2 section view B shows a cross-sectional cut through of the tip assembly 200. The tip assembly 200 includes a tip 210, a tip silencer 220, a ferrule 240, a tip insert 230, and a foam plug 250. The exploded assembly break out view shows how the individual components of the tip assembly 200 appear as individual pieces able to be collapsed into the tip assembly 200. The foam plug 250 and the tip insert 230 are adapted to be inserted in a central cylindrical cavity 290 of the shaft 201 of the tip assembly 200, the cavity 290 being up sufficient length to accept the tip insert. The tip insert 230 is secured, generally by epoxy or similar bonding material, to the inside wall of the cavity 290 of the shaft 201. Before the tip insert is inserted into the cavity, the foam plug 250 is inserted into the cavity. The purpose of the foam plug 250 is to prevent any loose bonding material, once hardened, from escaping the vicinity of the tip insert 230 and causing a rattle or undesirable noise in the cavity 290 of the shaft 101.

Continuing to refer to FIG. 2, the tip insert 230 is constructed from a material to adequately accept the forces generated on the tip without material failure and of sufficient bond strength to robustly resist separation from the tip and the inside cavity 290 of the shaft 201. Such materials include glass-fiber or carbon-fiber reinforced epoxy resins (e.g., G10/FR4). The tip insert 230 includes an inwardly extending portion 232 to interface with the cavity 290 and a tip disk 231 to provide a flat surface for the tip 210 or tip silencer 220 to be bonded to. The inwardly extending section 232 of the tip insert 230 includes one or more aligning protrusions (371 and 372 of FIG. 3) configured to center the tip insert 230 in the cavity 290 of the shaft 101.

The ferrule 240 is adapted to surround the tenon 205 of the shaft 201 and, along with the tip insert 230, sandwich the tenon 205 between two bonding layers, the two bonding layers protecting the tenon and transferring forces applied by tip 210 to the tip insert 230 and ferrule 240. Specifically, the ferrule 240 is secured to the outer surface of the tenon 205 and generally prevents splintering, cracks, and separations from forming in the shaft 201. With the tip insert 230 and ferrule 240 positioned on the shaft 201, the tip 210 and tip 220 silencer positioned on the flat surface defined by the end face of the tip disc 232 and the edge of the ferrule 240. The tip silencer 220 has a cylindrical plate shape, and is constructed from a material sufficient for damping the high-frequency forces generated during a strike of the ball with the tip 210. One such suitable material for the tip silencer 210 is vulcanized fiber and others are known in the art. To sufficiently damped forces applied to the tip 210, the tip silencer should be at least 0.003 inches thick.

Figure 3:
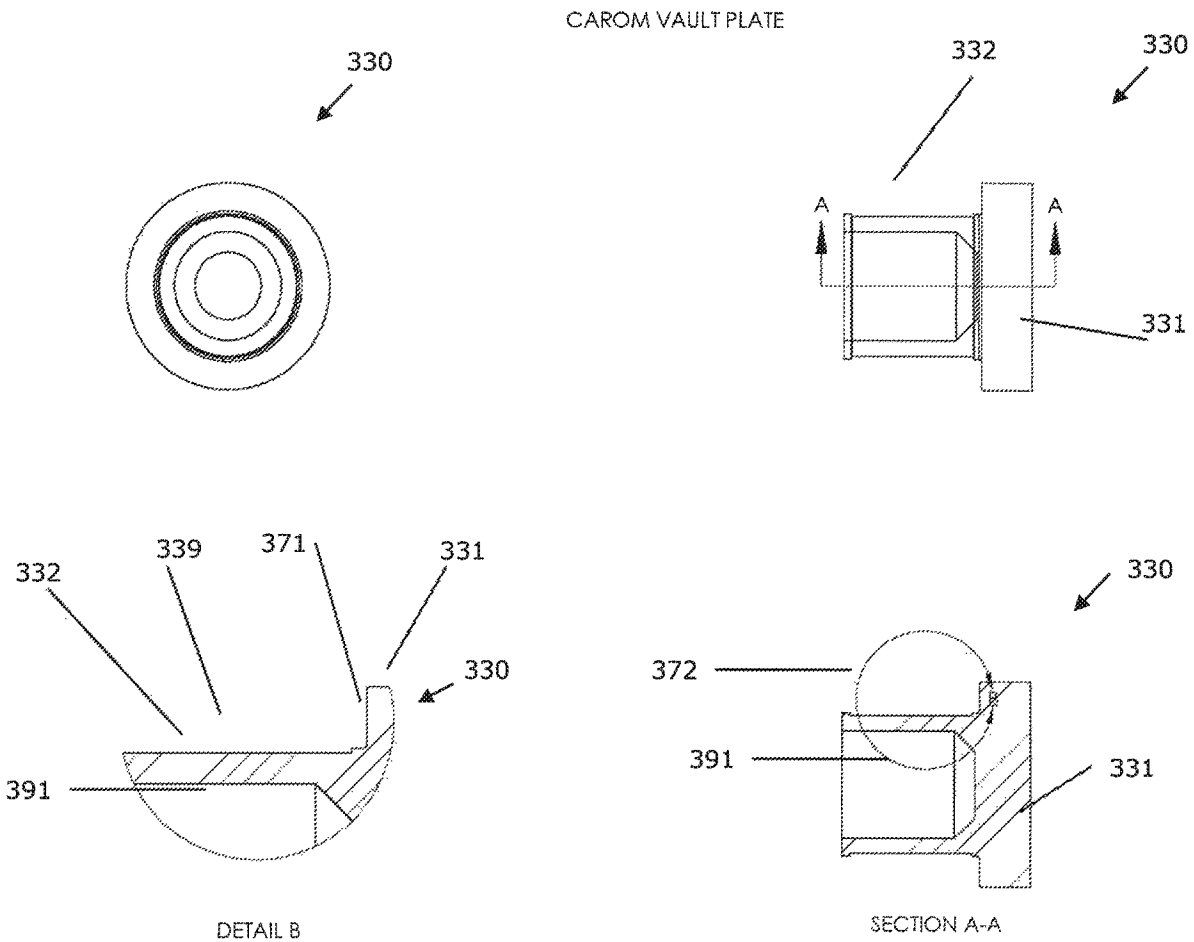
FIG. 3 is a schematic of the tip insert of FIG. 2.

FIG. 3 is schematic of the tip insert of FIG. 2. In FIG. 3, the tip insert 330, interchangeably referred to as a vault plate, has a cylindrical shape and includes a tip disc 331 adapted to cover the terminal edge of a shaft (201 in FIG. 2), and an inwardly extending section 332, e.g., an internal sleeve, adapted to interface and be bonded to the inner surface of the cavity of the shaft of FIG. 2. The inwardly extending section 332 of the tip insert 330 includes a proximal centering flange 371 adjacent to the tip disc 331 and distal centering flange 372 located at the terminal end of the inwardly extending section 332. The two centering flanges 371, 372 together locate online and center the tip insert in the cavity of the shaft of FIG. 2. The inwardly extending section 332 defines a bonding surface 339 recessed from the centering flanges 371, 372 of sufficient area and axial length to robustly bond the tip assembly 330 to the inside surface of a cue shaft.

In operation, the centering flanges 371, 372 allow precise locating of the tip insert 330 in the cavity of a shaft and, as a result, create a circumferentially consistent distance between the bond surface 339 of the inwardly extending section 332 of the tip insert 330 and the inner surface of a cavity of a shaft. The volume defined by the centering flanges 371, 372, the bonding surface 339, and the inner surface of a cavity (290 of FIG. 2) is referred to as the epoxy reservoir. The bonding surface 339 of the tip insert 330 is directly attached to the cue shaft tip cavity using any technique known to those in the art. Preferably, the tip and tip plate are attached in a manner such that the force of a ball strike is distributed along much of the surface of contact between the tip and the tip plate. For example, an epoxy or other adhesive (e.g., DP420 epoxy adhesive by the 3M Corporation) is used to directly attach the tip and the tip plate in a preferred embodiment of the invention.

Continuing to refer to FIG. 3, the tip insert 330 is designed to robustly transfer forces from a tip or tip silencer of a tip assembly to the shaft having the tip assembly. In transferring the force, a sufficient bond length or bonds surface areas is required to prevent degradation of the bond over repeated strikes of the tip during the play of billiards or pool. A substantially consistence bonding distance between the bonding surface 339 of the tip insert 330 and the inner surface of the cavity (290 in FIG. 3) advantageously mitigates asymmetric bonding strengths between the tip insert 330 and inner surface of the cavity (290 in FIG. 2), thereby increasing the overall durability of the tip assembly by reducing the likelihood of bonding failures between the tip insert 330 and the shaft (201 in FIG. 2).

Furthermore, the cavity 391 of the tip insert 330 provides a method for attaching a tip to a cue stick that tends to make the front end lighter than using a conventional solid cue attachment plug. In contrast to the use of a plug, a conventional solid tenon, or other prior art devices to attach the tip to the distal end of the cue stick, the tip insert 330 cavity 391 decreases the weight present at the tip end of the cue stick (201 FIG. 2), thereby decreasing the effects of cue ball deflection. In addition, when using a cue shaft including a tip cavity, the tip insert 330 stiffens the tip end of the shaft and results in an increased speed for a ball struck by the cue.

Figure 4A:
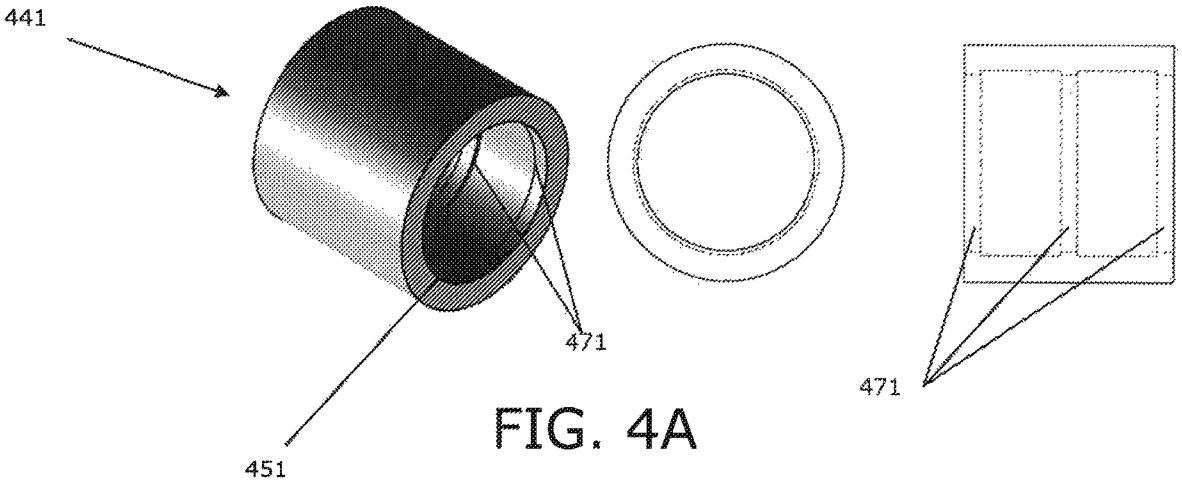
FIGS. 4A-4B are three-view schematics of the ferrule of FIG. 2.
Figure 4B:
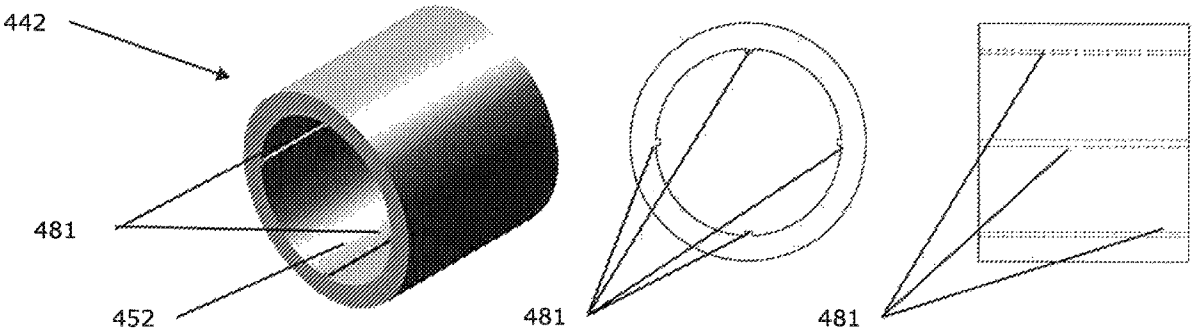

FIGS. 4A-4B are three-view schematics of the ferrule of FIG. 2 having embodiments of the present invention. FIG. 4A shows an embodiment of the present invention including a ferrule adapted to interface with the outer surface of the tendon of the shaft. FIG. 4A shows the ferrule 441 having an inner surface 451 with the plurality of centering flange 471*s*, the centering flanges 471 aligning the inner surface of the ferrule around the outer surface of a tenon (205 of FIG. 2) and positioning the inner surface 451 of the ferrule 441 a substantially consistent difference distance away from an outer surface of the tenon of the shaft (201 of FIG. 2). The centering flanges 471 thereby enable a circumferentially consistent bonding distance between the inner surface of the ferrule 441 and the outer surface of the axial tenon of the shaft (201 of FIG. 2).

FIG. 4B shows an alternative configuration of the ferrule of embodiments of the present invention. The ferrule 442 includes an inner surface 452 having a plurality of axial ribs 481 protruding from the inner surface 452 at sufficient to center the inner surface of the fair rule around in outer surface of an axial tenon of the shaft of the billiards to. Similar to the plurality of centering flanges 471 of the ferrule 441 of FIG. 4A, the plurality of axial ribs 481 of the ferrule 442 of FIG. 4B enable a substantially consistent bonding difference between the inner surface 452 of the ferrule 442 and the outer surface of the axial tenon of the shaft (201 of FIG. 2). In operation, the ferrule 441 of FIG. 4A or the ferrule 442 of FIG. 4B, along with the tip insert of FIG. 3, creates a substantially consistent bonding distances between the outer surface of an axial tenon an inner surface of a cavity, thereby sandwiching the terminal end of the shaft within an extremely durable bond as compared to methods engaging only one the outer surface of the tenon.

Figure 5:
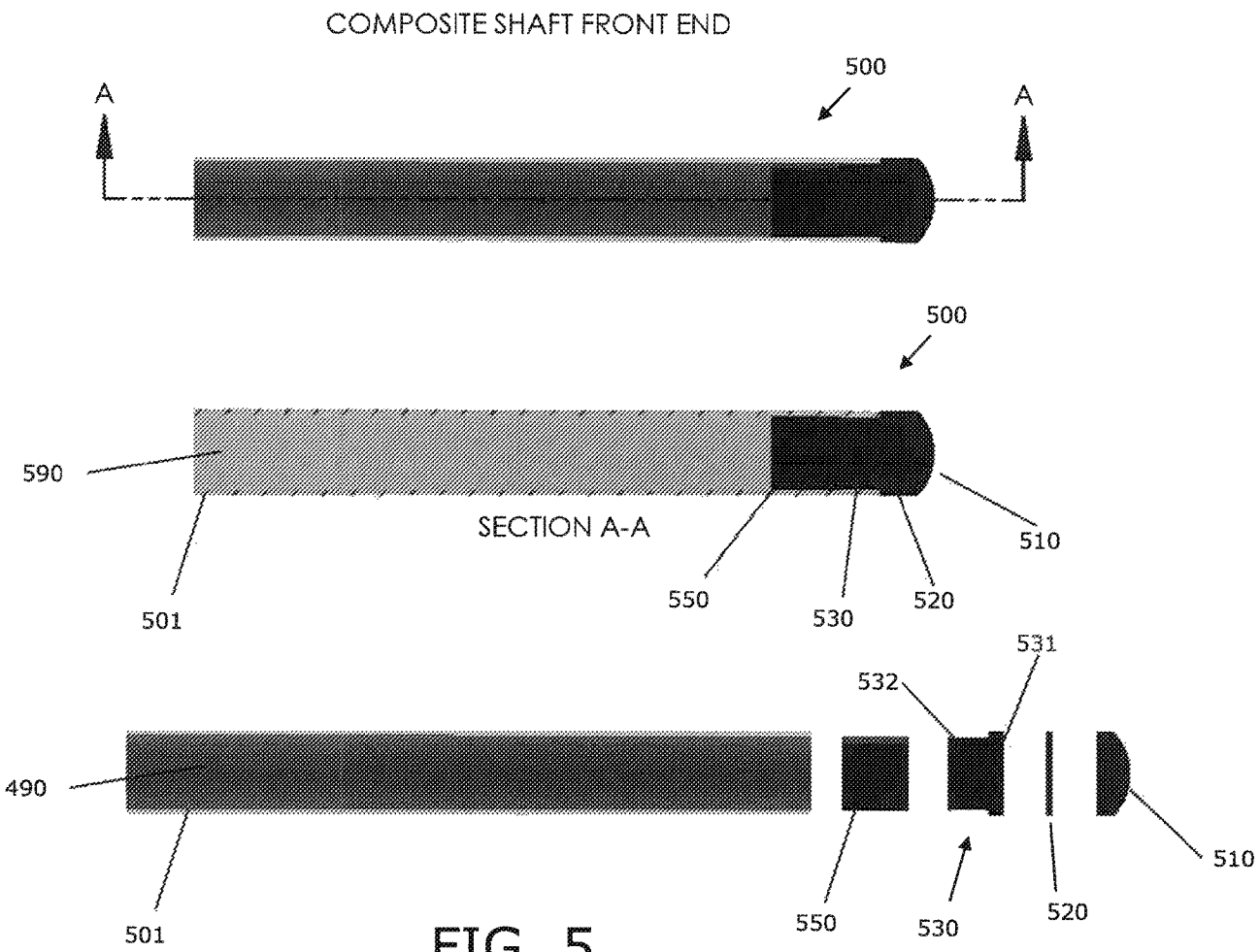
FIG. 5 is an assembly diagram of a composite shaft tip assembly embodiment of the present invention.

FIG. 5 is an assembly diagram of a composite shaft tip assembly having embodiments of the present invention. FIG. 5 illustrates an embodiment of the present invention incorporated into a composite shaft 501 of the billiards cue tip assembly 500. The composite shaft 501 does not include a tenon and therefore removes the necessity of a ferrule to protect the tip end of the shaft. The tip assembly 500 includes the composite shaft 501, a tip 510, and tip insert 530, and optionally a tip silencer 520 and a foam plug 550. The tip insert 530 includes a tip disc 531 and an inwardly extending section 532 adapted be bonded to the inner surface of the cavity 590 of the shaft 501. The inwardly extending section 532 of the tip insert 530 includes one or more aligning protrusion (not shown) to center the tip insert 530 in the cavity 590 of the shaft 501 and enable a circumferentially consistent bonding distance between the inner surface of the cavity 590 and the inwardly extending section 532 of the tip insert 530, thereby mitigating the formation of an asymmetric bonding region.

Figure 6:
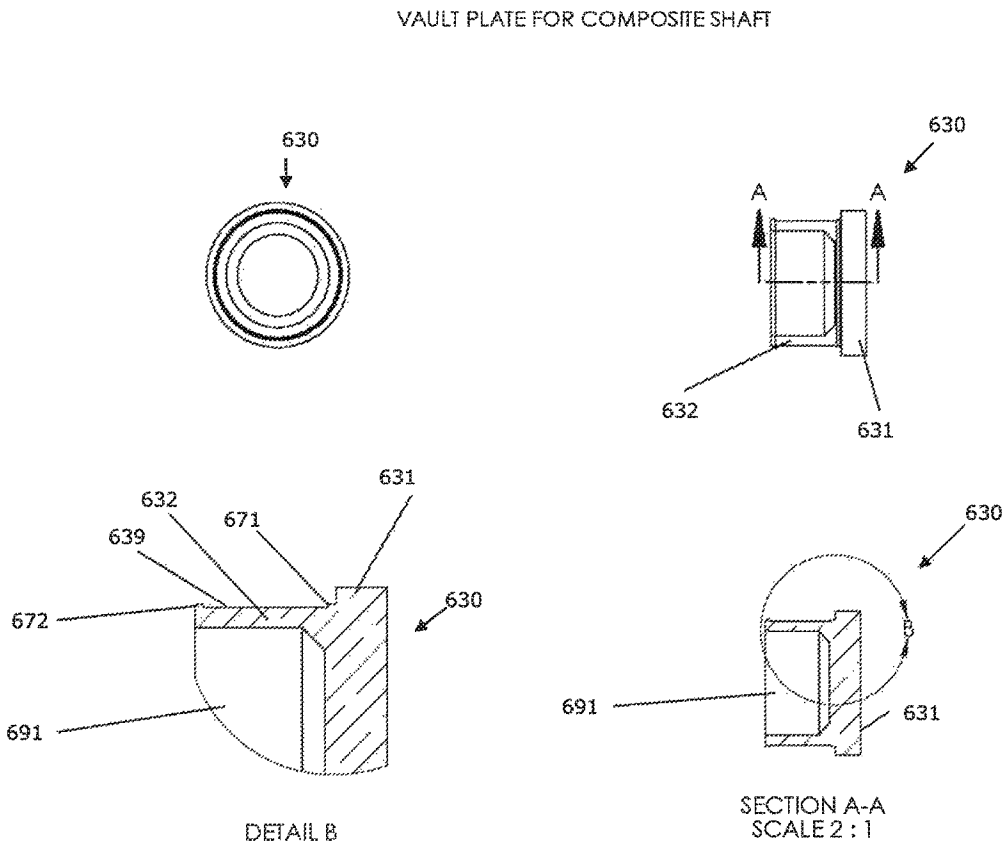
FIG. 6 is a schematic of the tip insert of FIG. 4.

FIG. 6 is a schematic of the tip insert of FIG. 5. The tip insert 630 has a cylindrical shape configured to interface with a cavity in a cylindrical shaft. The tip insert 630 includes a tip disc 631 adapted to accept a tip or tip silencer of a tip assembly (500 in FIG. 5) and an inwardly extending section 632 adapted to be centered in and bonded to a cylindrical cavity. The inwardly extending section 632 optionally includes a tip cavity 691 to reduce the overall weight of the tip insert 630. As shown in detail B, the tip insert 630 inwardly extending section 632 includes a first centering flange 671 adjacent to the tip disc 631 and a second centering flange 672 at the terminal end of the inwardly extending section 632. The centering flanges 671, 672 have an outer diameter adapted to interface with the inner diameter of a cavity of the cue shaft. The inwardly extending section 632 defines a bonding surface 639 between the first centering flange 671 and the second centering flange 672. The bonding surface 639 is adapted to be bonded to the inner surface of a cavity in the tip end of a cue shaft.

Figure 7:
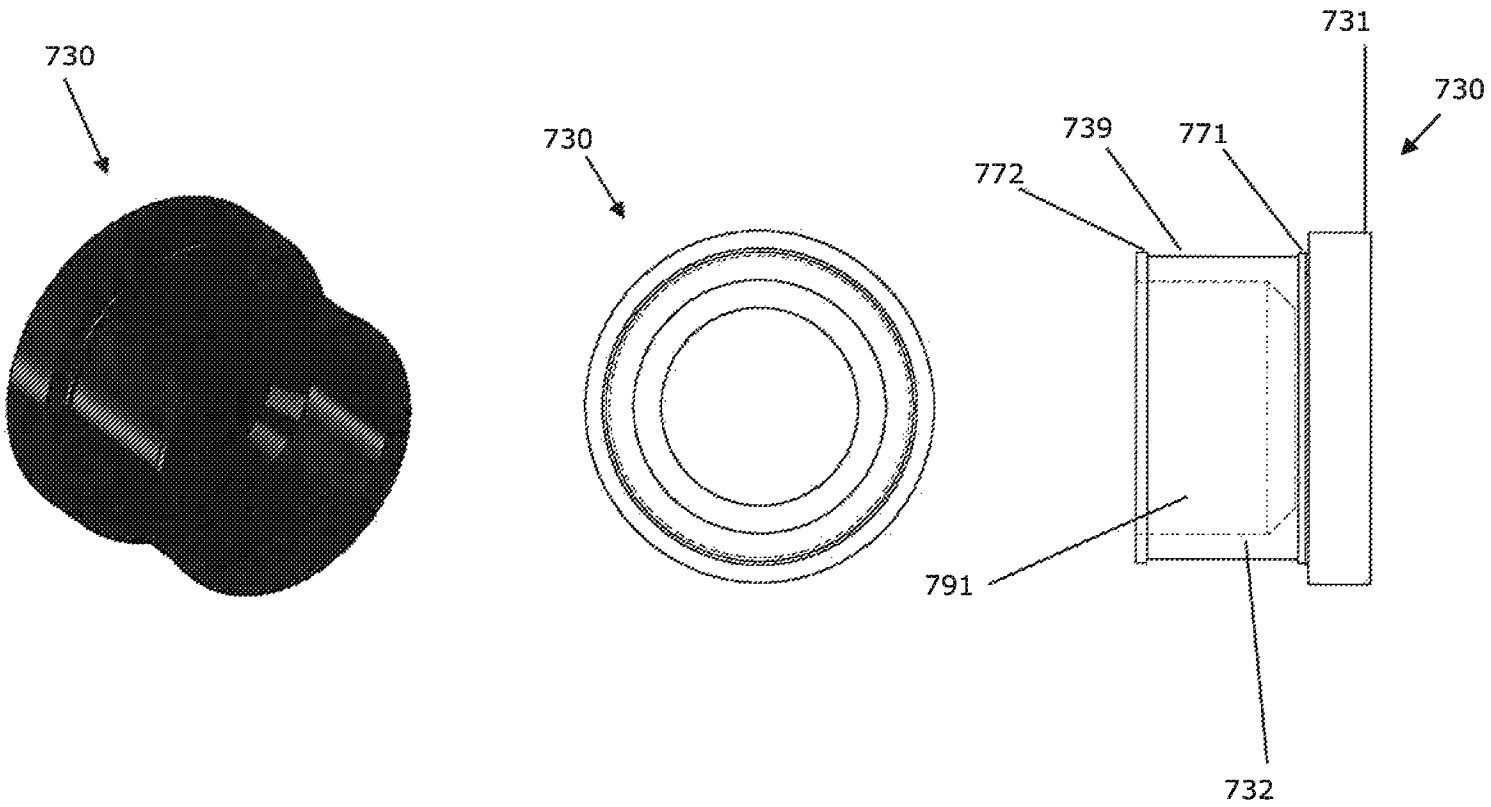
FIG. 7 is a three-view diagram of the tip insert of FIG. 4.

FIG. 7 is three-view diagram of the tip insert of FIG. 6. FIG. 7 is a detailed view of the tip assembly of FIG. 5, showing a perspective view of the tip insert 730. The tip insert 730 having a tip disc 731 and an inwardly extending section 732, the inwardly extending section 732 having a tip cavity 791, a first centering flange 771 adjacent to the tip disc 731 and a second centering flange 732 at the terminal end of the inwardly extending section 732. The inwardly extending section 732 also defines a bonding surface 739 between the first and second centering flange 771, 772. The bonding surface 739 having a bonding surface area and an axial length along a center axis of the tip insert 730, the bonding area and bonding length are sufficient to robustly secure on the tip insert to the inner surface of the cavity of a cue shaft.

Figure 8:
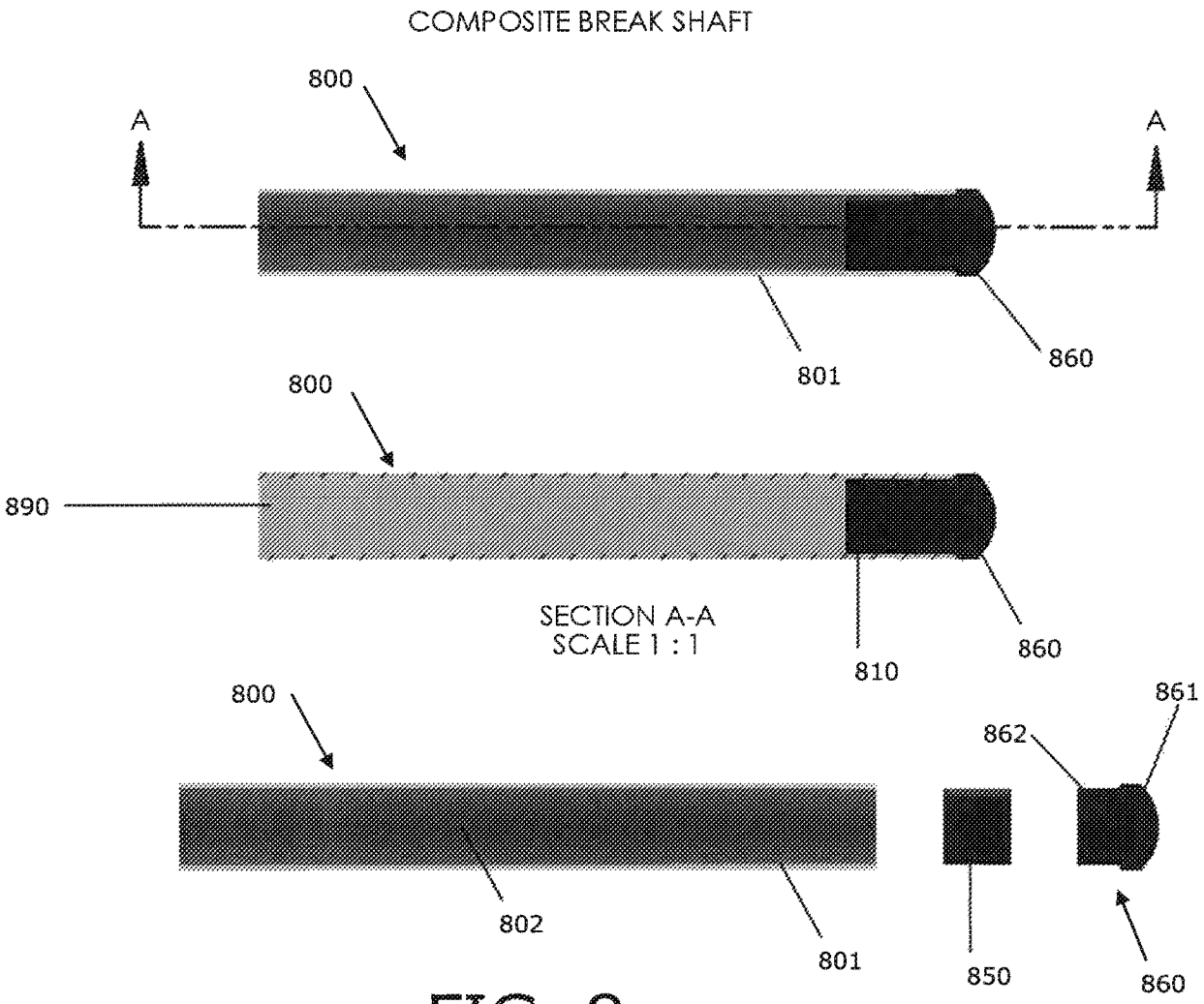
FIG. 8 is an assembly diagram of a composite shaft tip assembly of a break cue having embodiments of the present invention.

FIG. 8 is an assembly diagram of a composite shaft tip assembly of a break cue having embodiments of the present invention. FIG. 8 shows the break tip assembly 800 including the tip end of a composite cue shaft 501. Composite cue shafts 801 of the design shown include a tip insert 860 and a foam plug 850. The tip insert 860 includes a tip disc 861 having an integrated tip and an inwardly extending section 862 adapted to be inserted into the cavity 890 of the tip end of the composite break shaft 801. Break cues are employed sporadically throughout billiards games for certain types of hard-hitting shots, such as those used to open the game of pool. As a result, players attempting break shots are less concerned about off angle strikes on the ball and have less of a need for a standard leather tip. To address this particular style of cue, embodiments of the present invention include a tip insert 860 with a tip disc 861 having an integrated tip to increased durability of the break tip assembly.

Figure 9:
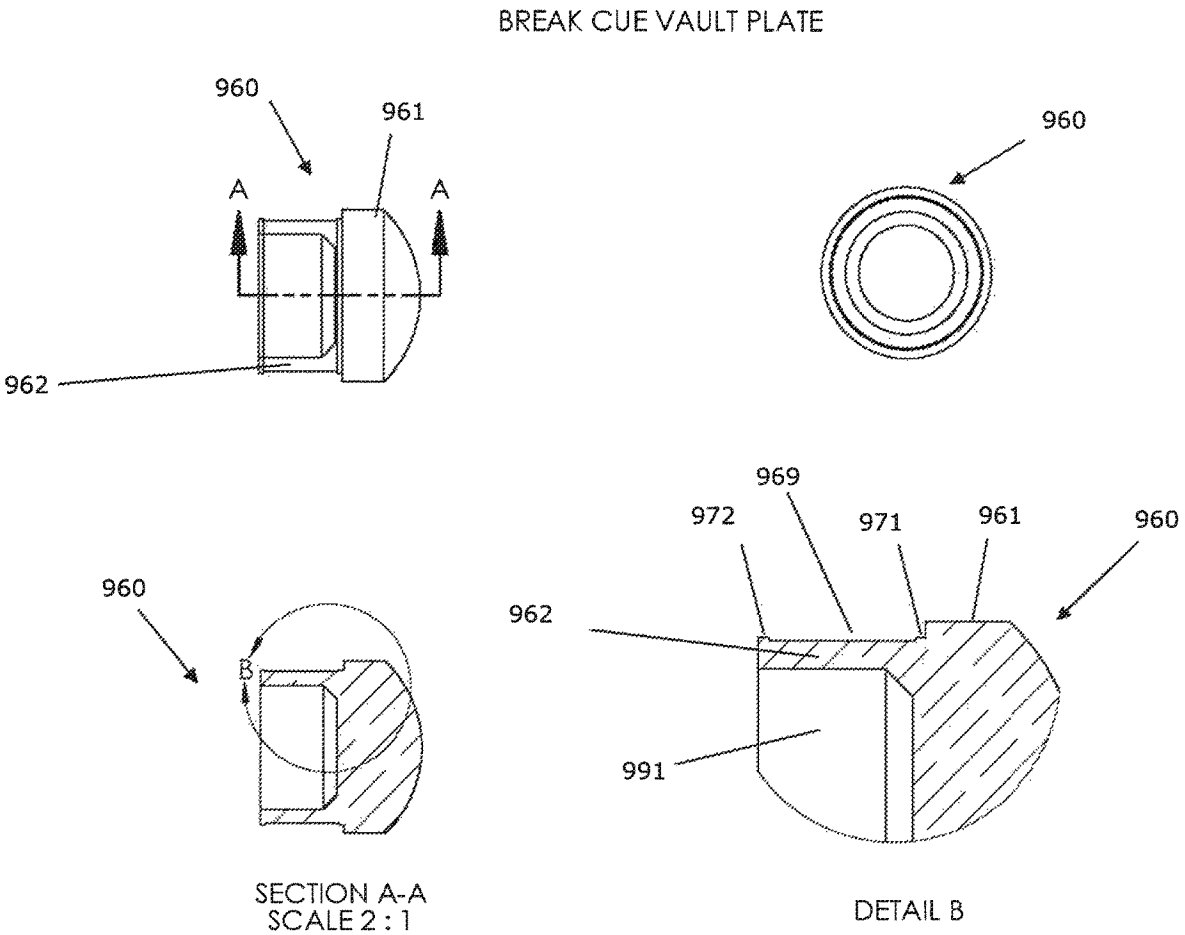
FIG. 9 is schematic of the tip insert with integrated tip of FIG. 7 with centering flanges.

FIG. 9 is schematic of the tip insert with integrated tip of FIG. 8. FIG. 9 shows the tip insert, also known as the vault plates including a tip disc 961 and inwardly extending section 962, the tip disc 961 comprising an integrated tip for striking a ball. The inwardly extending section 962 of the tip insert 960 can optionally have a tip cavity 991 formed therein for weight reduction purposes. The inwardly extending section 962 includes a first cylindrical centering flange 971 and a second cylindrical centering flange 972, the first cylindrical centering flange 971 is located adjacent to the tip disc 961 and the second cylindrical centering flange 972 is located at the terminal and of the inwardly extending section 962. Between the first and second cylindrical flanges 971, 972 is a bonding surface 969 adapted to bond the inwardly extending section of the tip insert 960 to the inner surface of a tip cavity of a composite brake cue shaft.

Figure 10:
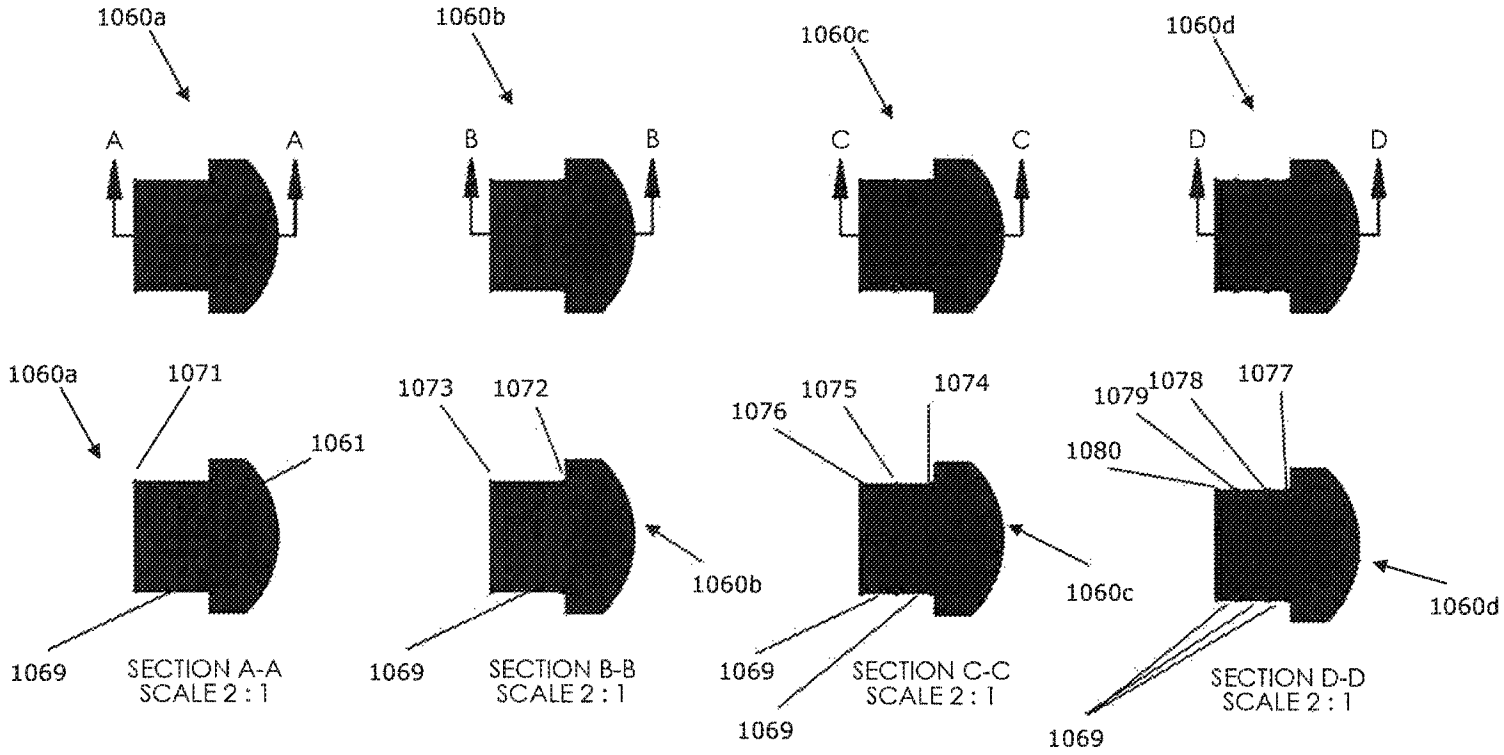
FIGS. 10A-D are diagrams of tip inserts with integrated tips, the tip inserts having one, two, three, and four centering flanges.

FIGS. 10A-10D are diagrams of tip inserts (generally 1060) with integrated tips, the tip inserts having one, two, three, and four centering flanges. FIGS. 10A-10D show the tip insert of FIG. 9 in four different configurations of centering flanges on the inwardly extending section. FIG. 10A shows a tip insert 1060*a* having a single centering flange 1071 at the terminal end of the end of the tip insert 1060*a*. The tip insert 1060*a* includes the bonding surface 1069 between the single centering flange 1071 and the tip disc 106. FIG. 10B shows a tip insert 1060*b* having a first centering flange 1072 and a second centering flange 1073, and the bonding surface 1069 formed between the first centering flange 1072 and the second centering flange 1073. FIG. 10C shows a tip insert 1060*c* having three centering flanges 1074, 1075, 1076, and a bonding surface 1069 positioned between the first and second centering flanges and in between the second and third centering flanges. FIG. 10D shows the tip insert 1060*d* having four centering flanges 1077-1080, the bonding surface 1069 formed between each of the centering flanges.

Figure 11:
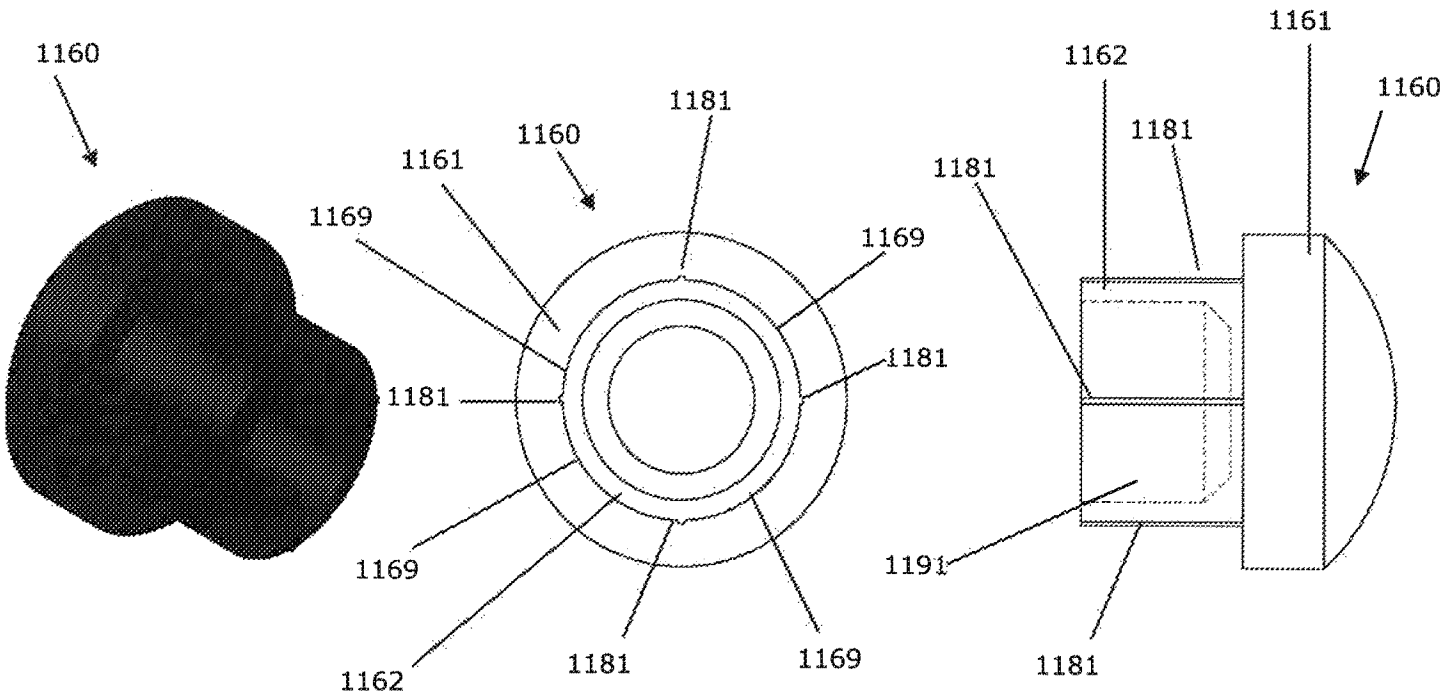
FIG. 11 is schematic of the tip insert with integrated tip of FIG. 7 with centering ribs.

FIG. 11 is schematic of the tip insert with integrated tip of FIG. 8 with centering ribs. FIG. 11 shows an alternate embodiment of the present invention where the tip insert 1160 includes an inwardly extending section 1162 with four axially located centering ribs 1181 located thereon and a tip disc 1161 comprising an integrated tip. Each of the centering ribs 1181 extends the length of the inwardly extending section 1162 and protrudes a small distance in to center the tip insert 1160 in a cavity of a composite brake shaft. A bonding surface 1169 is located between the four centering ribs 1181 of the inwardly extending section 1162 to accept a bond from of an adhesive, such as epoxy, to the inner surface of the cavity of the composite brake shaft.

Figure 12:
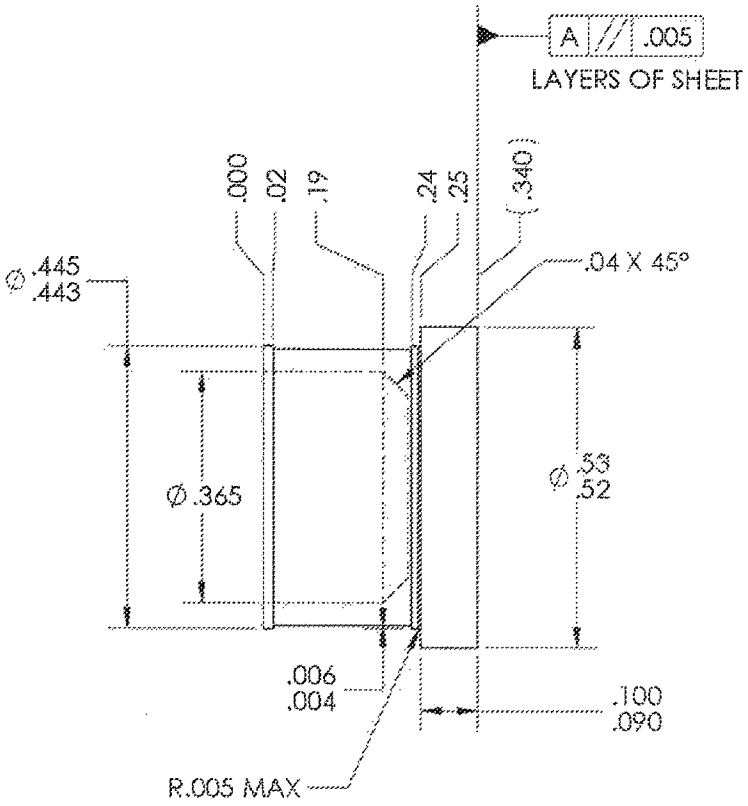
FIG. 12 is a dimensioned schematic of a typical tip insert embodiment of the present invention.

FIG. 12 is a dimensioned schematic of a typical tip insert having embodiments of the present invention. FIG. 12 shows example dimension drawing of a tip insert having embodiments of the present invention. Datum A indicates the direction of the layers of a material comprising the tip insert. Fiber-reinforced epoxy laminate sheets are pressed into a single block of composite material (e.g., G10/FR4) and the tip insert of FIG. 12 is machined from the material, the laminate sheet being oriented parallel to the front face of the tip disc of the tip insert. Advantageously the orientation of the layers of the epoxy laminate sheets being perpendicular to the center axis of the tip inserts resist delamination of the tip inserts occurring from repeated force loads in the axial direction, as induced by an attached tip repeatedly striking the ball, for example during a game of pool. In positioning the layers of epoxy laminate perpendicular to the center axis of the tip insert, the edges of the epoxy laminate are located at the periphery of the tip insert and are therefore not directly exposed forces exerted on a tip of the cue shaft.

Figure 13:
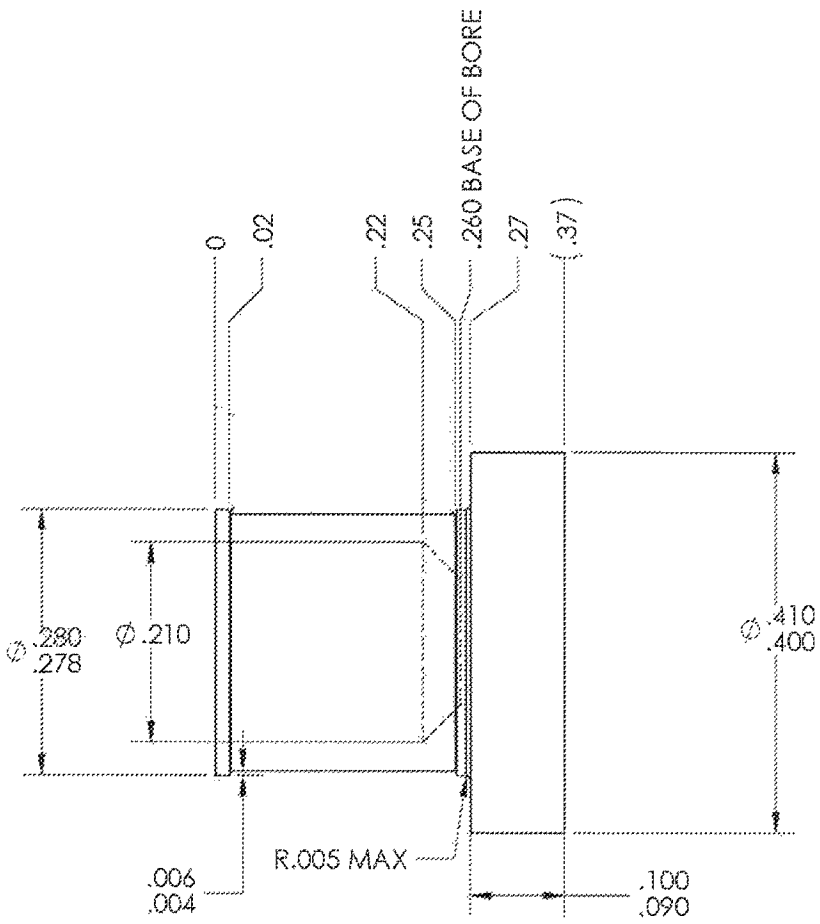
FIG. 13 is a dimensioned schematic of a typical tip insert embodiment of the present invention.

FIG. 13 is a dimensioned schematic of a typical tip insert having embodiments of the present invention. FIG. 13 shows alternative example dimensions for the tip insert having embodiments of the present invention as described in detail above.

Figure 14:
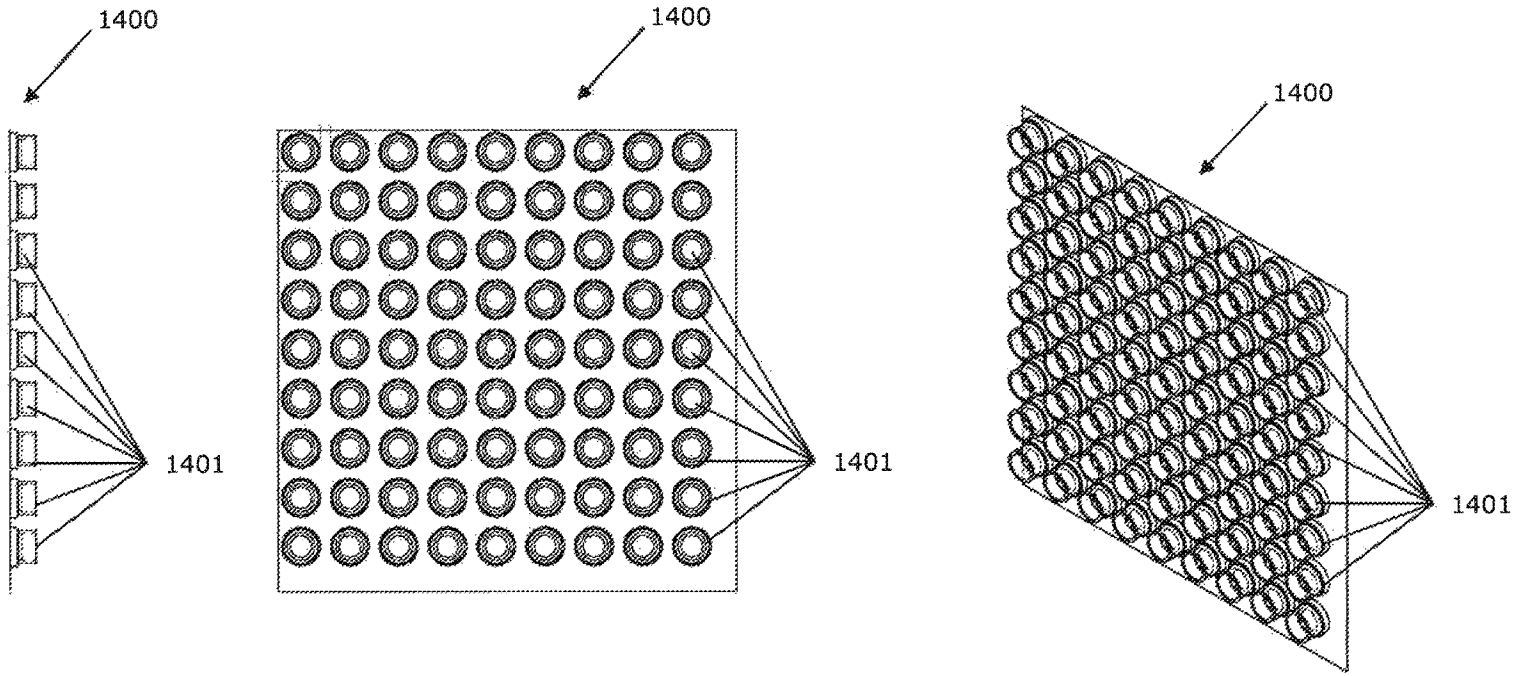
FIG. 14 is schematic of a solid block of G-10 fiber-reinforced epoxy laminate with a plurality of tip inserts machined therefrom.

FIG. 14 is schematic of a solid block of G-10 fiber-reinforced epoxy laminate with a plurality of tip inserts machined (e.g., milled) therefrom. FIG. 14 shows a construction technique for the manufacture of individual tip inserts from a single block of composite material in accord with embodiments of the present invention. A single block of fiber reinforced epoxy laminate material 1400 having sheets are oriented parallel to the tip discs of the individual tip inserts is show with individual tip insert 1401 machined therefrom.

Figure 15:
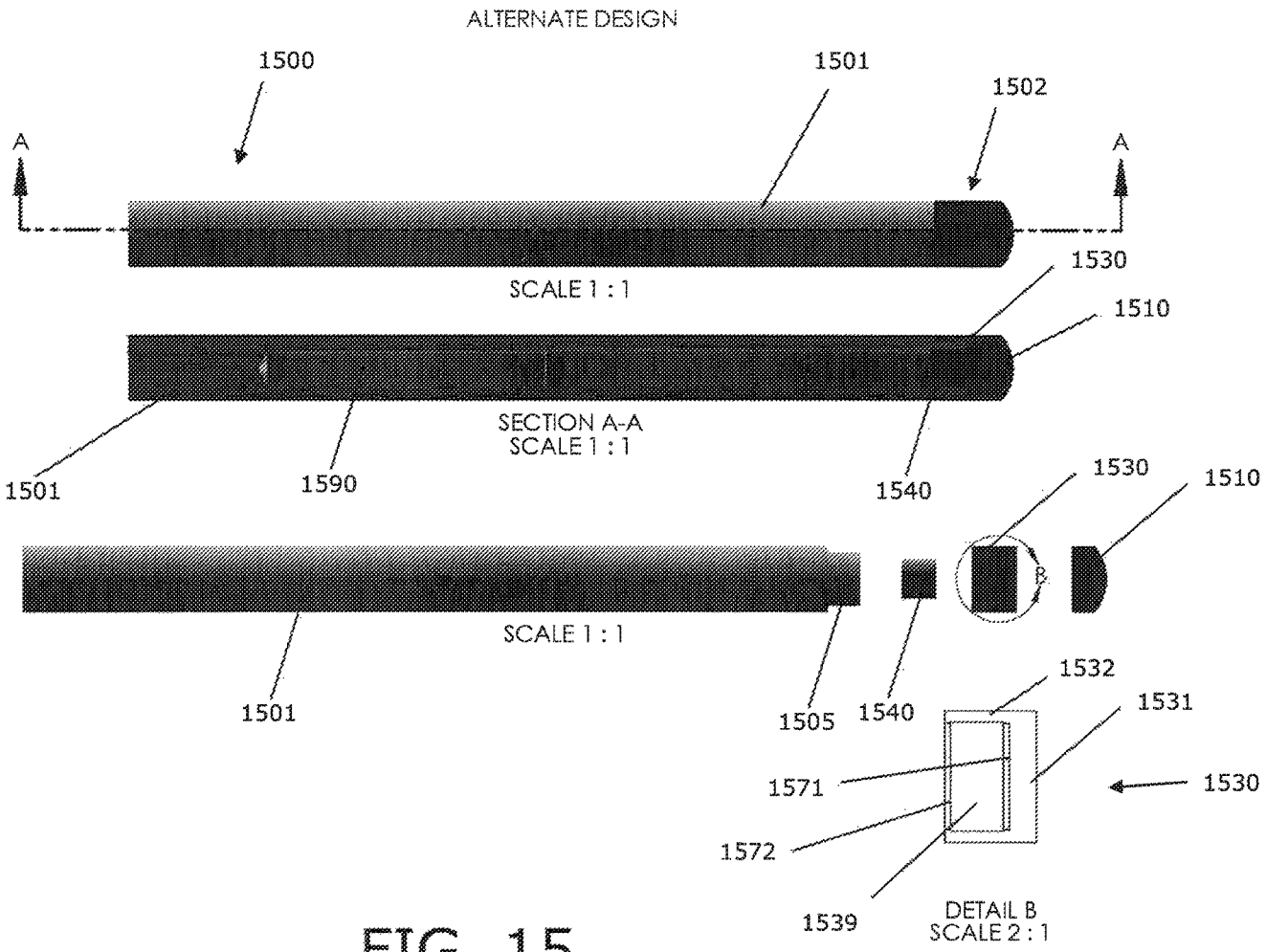
FIG. 15 is an assembly diagram of an integrated ferrule and tip insert embodiment of the present invention.

FIG. 15 is an assembly diagram of an integrated ferrule and tip insert having embodiments of the present invention. FIG. 15 shows a cue stick 1501 having a shaft 1501 with a tip assembly disposed at once end. The tip end of the shaft 1501 includes a tenon 1505 and a cavity 1590, as previously described. The tip assembly includes a tip 1510, an integrate ferrule 1530 constructed from fiber-reinforced epoxy laminate sheets oriented perpendicular to the axis of the shaft 1501, and a tip insert 1540. The integrate ferrule 1530 comprises an external sleeve 1532 and a tip disc 1531. The sleeve 1532 is adapted to be bonded to the outer surface of the tenon 1505 and the tip disc is adapted to be bonded to the tip 1510. The sleeve 1532 includes a first centering flange 1571 adjacent to the tip disc 1531, a second centering flange at the terminal end of the integrated ferrule 1532, and a bonding surface disposed between the two centering flanges 1571, 1572. The bonding region 1532, two centering flanges 1571, 1572, define an epoxy reservoir and enable a substantially consistent bonding distance between the bonding surface 1539 and the outer surface of the tenon 1505. The tip insert 1540 is adapted to be bonded to the inner surface of the cavity and, optionally, to the inner surface of the tip disc 1531 of the integrated ferrule 1530. The integrated ferrule 1530 and tip insert 1540 together sandwich both the inner and outer surface of the shaft tenon 1505 and robustly secure the tip 1510 to the shaft 1501. Ideally, the tip insert 1540 comprises one or more centering protrusions to entire a substantially consistent bond distance about both the inner and outer surfaces of the tenon 1505.

Figure 16A:
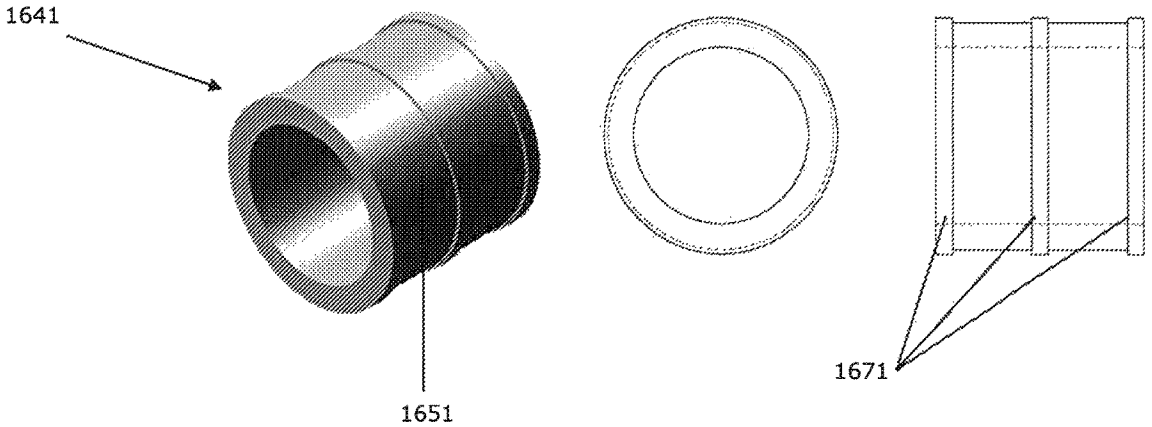
FIGS. 16A-B are three-view schematics of the tip insert of FIG. 15.
Figure 16B:
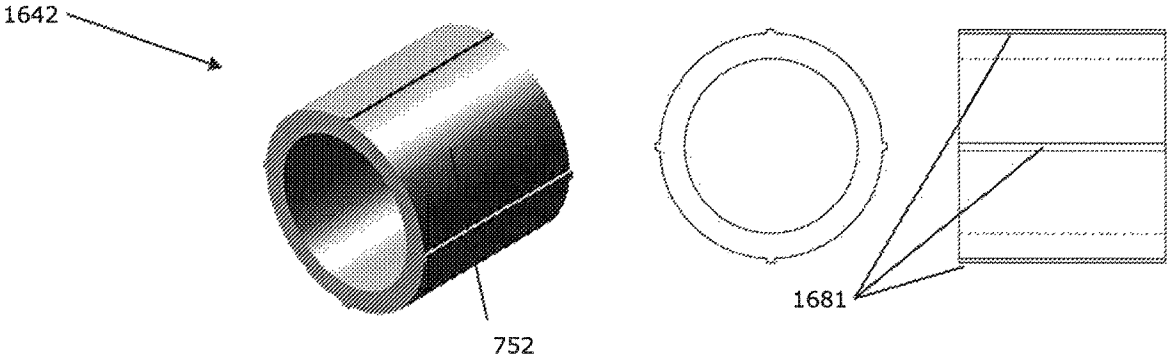

FIGS. 16A-B are three-view schematics of the tip insert of FIG. 15 having two embodiments of the present invention. FIG. 16A shows a tip insert 1641 comprising an outer surface 1651 and three centering flanges 1671. FIG. 16B shows a tip insert 1642 comprising an outer surface 1652 and four axial centering ribs 1681.

Figure 17:
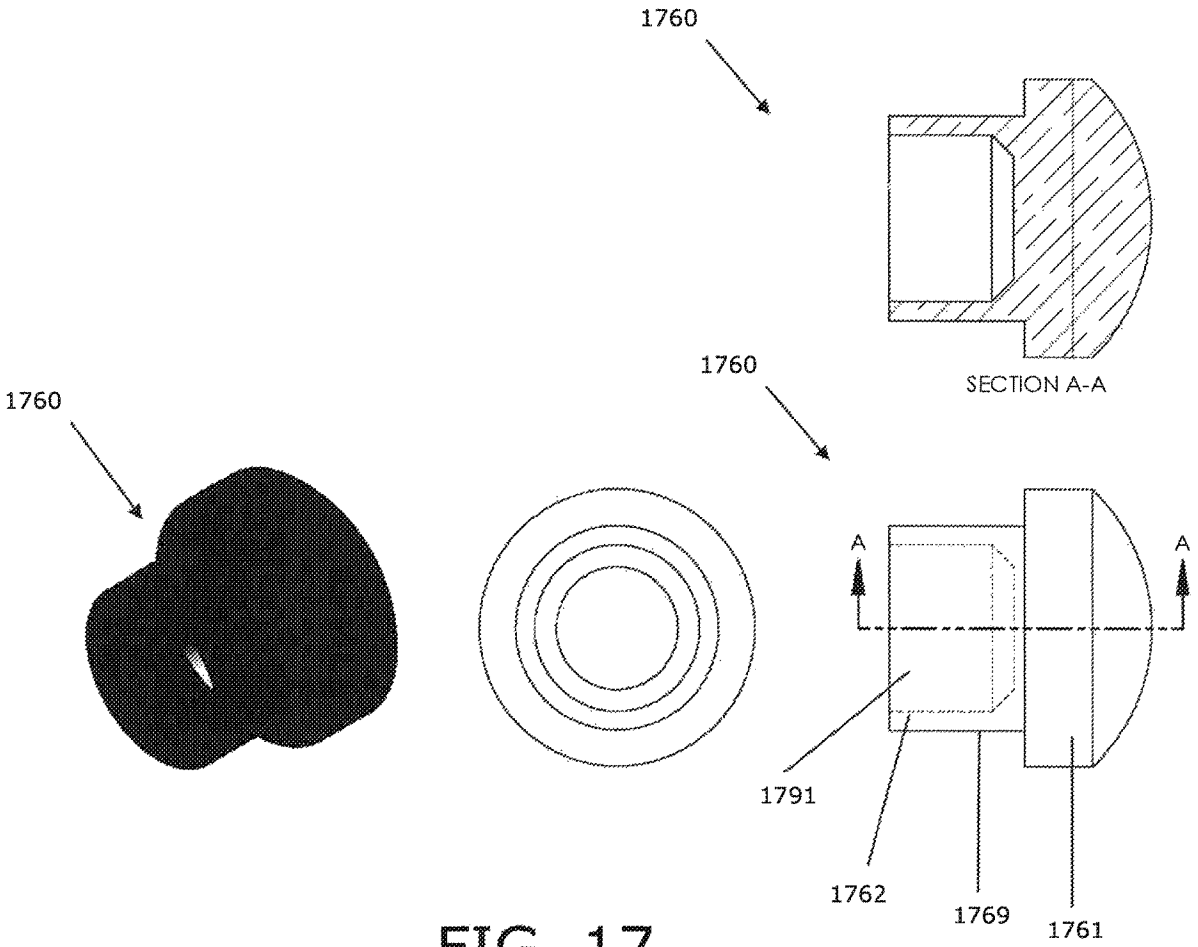
FIG. 17 is a three-view diagram of a tip insert embodiment of the present invention.

FIG. 17 is a three-view diagram of a tip insert embodiment of the present invention. A tip insert 1760 with integrated tip includes a tip disc 1761 and an inwardly extending section 1762, however the integrated tip may be a standard tip adhered to an end surface of the tip disc as previously described. The inwardly extending section 1762 is configured to be inserted into cavity at a tip end of a cue shaft and includes a bonding surface 1769 adapted to be bonded to the inside surface of the cavity. As disclosed above, the tip insert 1760 in FIG. 17 is machined from fiber-reinforced epoxy laminate with the sheets orientated perpendicular to the center axis of the tip insert 1760. Additionally, the tip insert includes a weight-reducing cavity 1791 to reduce unnecessary end-mass in the tip assembly of a cue shaft.

While this invention has been particularly shown and described with references to example embodiments thereof, it will be understood by those skilled in the art that various changes in form and details may be made therein without departing from the scope of the invention encompassed by the appended claims.

What is claimed is:

1. A cue shaft tip assembly comprising:

a shaft with a cavity at a tip end, the cavity having an inner surface;

a tip insert at the tip end of the shaft, the tip insert having a tip disc and an inwardly extending section, the inwardly extending section comprising:

one or more aligning protrusions configured to interface with the inner surface of the cavity, a bonding surface adjacent to the one or more centering protrusions, and an epoxy reservoir formed around between the bonding surface and the inner surface of the cavity; and a tip at an end face of the tip disc for striking a ball;

wherein the tip insert is machined from a single piece of material comprising fiber-reinforced epoxy laminate sheets oriented perpendicular to a longitudinal axis of the shaft.

2. The tip assembly of claim 1, wherein the tip is integrated with the tip disc, the tip and tip disc being formed from the single piece of material.

3. The tip assembly of claim 1, wherein the tip insert is comprised of fiber-reinforced epoxy laminate sheets, at least a portion of the fiber-reinforced epoxy laminate sheets forming the tip disc being oriented perpendicular to a longitudinal axis of the shaft.

4. The tip assembly of claim 3, wherein the fiber-reinforced epoxy laminate sheets are selected from the group consisting of carbon fiber-reinforced epoxy laminate sheets and fiberglass epoxy laminate sheets.

5. The tip assembly of claim 3, wherein the fiber-reinforced epoxy laminate sheets are G-10/FR4 fiberglass epoxy laminate sheets.

6. The tip assembly of claim 1, wherein the one or more aligning protrusions are at least one of one or more centering flanges and a plurality of axially oriented centering ribs.

7. A cue shaft tip assembly comprising:

a shaft with a cavity and an axial tenon at a tip end, the cavity having an inner surface and the axial tenon having an outer surface;

a tip insert in the cavity at the tip end of the shaft, the tip insert comprising a bonding surface adapted to be bonded to the inner surface of the cavity;

an integrated ferrule adapted to surround the outer surface of the axial tenon, the integrated ferrule comprising:

a tip disc adapted to cover the tip end of the shaft;

an inner surfacing comprising a bonding surface and one or more inwardly facing aligning protrusions, the one or more inwardly facing aligning protrusions interfacing with the outer surface of the axial tenon and enabling, an epoxy reservoir formed between the bonding surface and the outer surface of the axial tenon, and the integrated ferrule being made from fiber-reinforced epoxy laminate sheets, at least a portion of the fiber-reinforced epoxy laminate sheets forming the tip disc being oriented to be perpendicular to the longitudinal axis of the shaft; and a tip at an end face of the tip disc of the integrated ferrule for striking a ball.

8. The tip assembly of claim 7, wherein the one or more aligning protrusions centers the inwardly extending section around the axial tenon and enables a consistent bond distance between the bonding surface of the integrated ferrule and the outer surface of the elongated axial tenon in the epoxy reservoir of the integrated ferrule.

9. The tip assembly of claim 7, wherein the tip insert comprises a cavity.

10. The tip assembly of claim 7, wherein the one or more aligning protrusions are at least one of one or more centering flanges and a plurality of axially orientated center ribs.

11. The tip assembly of claim 7, wherein the integrated ferrule is machined from a single piece of material comprising G-10/FR4 fiberglass epoxy laminate sheets oriented perpendicular to a longitudinal axis of the shaft.

12. The tip assembly of claim 8, wherein the tip is integrated with the tip disc of the integrated ferrule, the tip and tip disc being formed from a single piece of material.

13. The tip assembly of claim 7, further including a tip silencer positioned between the tip and the tip disc of the integrated ferrule.

14. The tip assembly of claim 7, further including an adhesive in the epoxy reservoir, the adhesive securing the bonding surface of the integrated ferrule to the outer surface of the axial tenon.

15. The tip assembly of claim 7, the tip insert further including one or more aligning protrusions for centering the tip insert in the cavity of the shaft and enabling a consistent bond distance between the inner surface of the cavity and the bonding surface of the tip insert.

16. The tip assembly of claim 7, wherein the one or more aligning protrusions are at least one of one or more centering flanges and a plurality of axially oriented centering ribs.

17. A tip insert for a cue, the tip insert comprising:

a tip disc; and an inwardly extending section adapted to be inserted and attached to a tip end of a cue shaft having a cavity, the inwardly extending section comprising a bonding surface configured to be bonded to an inner surface of the cavity;

the tip insert being made from fiber-reinforced epoxy laminate sheets, at least a portion of the fiber-reinforced epoxy laminate sheets forming the tip disc being oriented to be perpendicular to the longitudinal axis of the shaft.

18. The tip insert of claim 17, wherein the fiber-reinforced epoxy laminate sheets forming the tip insert being oriented perpendicular to a longitudinal axis of the shaft.

19. The tip insert of claim 17, wherein the fiber-reinforced epoxy laminate sheets are selected from the group consisting of carbon fiber-reinforced epoxy laminate sheets and fiberglass epoxy laminate sheets.

20. The tip insert of claim 17, wherein the fiber-reinforced epoxy laminate sheets are G-10/FR4 fiberglass epoxy laminate sheets.

21. The tip insert of claim 17, further including a weight-reducing cavity.

22. The tip insert of claim 21, wherein the tip insert is machined from a single piece of material.

23. The tip insert of claim 21, wherein the tip disc comprises an integrated tip for striking a ball.

24. The tip insert of claim 17, further comprising:

one or more aligning protrusions configured to interface with the inner surface of the cavity, the bonding surface being adjacent to the one or more aligning protrusions; and an epoxy reservoir formed between the bonding surface and the cavity of the cue shaft, when positioned into the cavity of the cue shaft the one or more aligning protrusions enabling a substantially consistent bond distance between the inwardly extending section and the inner surface of the cavity in the epoxy reservoir.

25. The tip insert of claim 24, wherein the one or more aligning protrusions is one or more centering flanges.

26. The tip insert of claim 25, wherein the one or more aligning protrusions are a plurality of axially oriented centering ribs.

27. The tip insert of claim 17, wherein the inwardly extending section is a cylindrical inwardly extending section.

28. The method of claim 17, wherein the tip insert is constructed from fiber-reinforced epoxy laminate sheets being oriented perpendicular to a longitudinal axis of the tip insert.

* * * * *